US005963760A

United States Patent [19]

Takeda et al.

[11] Patent Number: 5,963,760

[45] Date of Patent: Oct. 5, 1999

[54] IMAGE FORMING APPARATUS AND IMAGE FORMING METHOD FOR IMAGE FORMATION USING INK

[75] Inventors: Katsuhiko Takeda, Toyonaka; Kazuko Taniguchi, Takatsuki, both of Japan

[73] Assignee: Minolta Co., Ltd., Osaka, Japan

[21] Appl. No.: 09/074,366

[22] Filed: May 8, 1998

[30] Foreign Application Priority Data

May 9, 1997 [JP] Japan ..... 9-119095

[51] Int. Cl.[6] ..... G03G 15/00

[52] U.S. Cl. ..... 399/159; 399/237

[58] Field of Search ..... 399/116, 130, 399/159, 162, 237, 239; 430/49

[56] References Cited

U.S. PATENT DOCUMENTS

| | | | |
|---|---|---|---|
| 3,901,700 | 8/1975 | Yoerger et al. | 430/49 |
| 3,924,945 | 12/1975 | Weigl | 399/237 X |
| 4,047,946 | 9/1977 | Croft | 399/159 X |
| 4,272,599 | 6/1981 | Moradzadeh . | |
| 5,596,396 | 1/1997 | Landa et al. | 399/237 |
| 5,708,932 | 1/1998 | Yano et al. | 399/159 |
| 5,715,501 | 2/1998 | Aita et al. | 399/159 |

FOREIGN PATENT DOCUMENTS

| | | |
|---|---|---|
| 07271107 | 10/1995 | Japan . |
| 07271198 | 10/1995 | Japan . |

*Primary Examiner*—Sandra Brase
*Attorney, Agent, or Firm*—McDermott, Will & Emery

[57] ABSTRACT

The present invention relates to an image forming apparatus provided with an image carrying member comprising a conductive substrate, a dielectric layer and a lubricative layer as a surface layer, a developing device comprising an ink carrying member which supports an ink layer, and a transporting device transporting the ink images to a recording medium. The present invention further relates to an image forming method comprising steps of forming electrostatic latent images on a surface of an image carrying member which comprises a conductive substrate, a dielectric layer and a lubricative layer, forming ink images on the image carrying member by means of contacting an ink to the electrostatic latent images on the image carrying member, and transporting the ink images to a recording medium.

20 Claims, 1 Drawing Sheet

IMAGE FORMING APPARATUS AND IMAGE FORMING METHOD FOR IMAGE FORMATION USING INK

RELATED APPLICATIONS

The present application is based on Japanese Patent Application No. HEI 9-119095, the content of which is incorporated herein by reference.

BACKGROUND OF THE INVENTION

1. Field Of the Invention

The present invention relates to an image forming apparatus and image forming method for forming an image on a recording medium by developing an electrostatic latent image, and specifically relates to an image forming apparatus and image forming method for image formation using ink.

2. Description of the Related Art

Conventional image forming apparatuses of the so-called electrophotographic type have become widely popular as electrophotographic copiers. The electrophotographic process is an image forming method comprising a process for uniformly charging the surface of a photosensitive member to a given polarity, a process for optically exposing said charged photosensitive member, a process for developing the formed electrostatic latent image using a developer containing a toner having a predetermined charge so as to obtain a visible image (toner image), a process for transferring said toner image from the photosensitive member to a recording sheet, and a process to fuse said toner image on said recording sheet. The electrophotographic process executes continuous image forming processes starting from the aforesaid process for charging the photosensitive member, and executes a cleaning process to remove residual toner from the surface of the photosensitive member, and an erasure process to eliminate residual charge from the photosensitive member between each consecutive image forming process. Dry type developer which develops a latent image using dry toner particles, and wet type (liquid) developer which develops a latent image using toner particles dispersed in a carrier fluid are used as developers in the electrophotographic process.

Although the electrophotographic process is an image forming method which has advantages such as excellent image quality, it does include certain disadvantages arising from developing an electrostatic latent image using toner particles having a predetermined charge inasmuch as, for example, dispersion in the amount of charge held by the toner particles causes toner particles to adhere to non-image areas of the photosensitive member, i.e., areas on which an electrostatic latent image is not formed, which results in image noise referred to as fog in the non-image areas of the image formed on a recording sheet. A further disadvantage of the electrophotographic process is the complexity between the apparatus construction and the executed processes which arises from the relationship between the photosensitive member and the toner used.

On the other hand, there are well known image forming methods which simplify the apparatus construction and processes, for example, by forming an electrostatic latent image on a dielectric element via discharge of a thin wire electrode or the like, developing said electrostatic latent image using ink, and transferring the obtained ink image to a recording sheet to produce an image. In this type of image forming process, however, a disadvantage arises inasmuch as there is a strong adhesion force between the ink and the dielectric element such that inadequate transfer to the recording sheet readily occurs. A further disadvantage to this type image forming method is that ink readily adheres to the non-image areas during development so as to produce fog in the image even after transfer to the recording sheet.

SUMMARY OF THE INVENTION

An object of the present invention is to provide a novel image forming apparatus and image forming method which eliminates the previously mentioned disadvantages.

Another object of the present invention is to provide an image forming apparatus having a simple construction and which provides excellent ink transfer efficiency.

Still another object of the present invention is to provide an image forming apparatus and image forming method which does not generate fog in the produced image.

The present invention relates to an image forming apparatus provided with an image carrying member comprising a conductive substrate, a dielectric layer and a lubricative layer as a surface layer, a developing device comprising an ink carrying member which supports an ink layer, and a transporting device transporting the ink images to a recording medium.

The present invention further relates to an image forming method comprising steps of forming electrostatic latent images on a surface of an image carrying member which comprises a conductive substrate, a dielectric layer and a lubricative layer, forming ink images on the image carrying member by means of contacting an ink to the electrostatic latent images on the image carrying member, and transporting the ink images to a recording medium.

DESCRIPTION OF THE PREFERRED EMBODIMENTS

Figure 1:
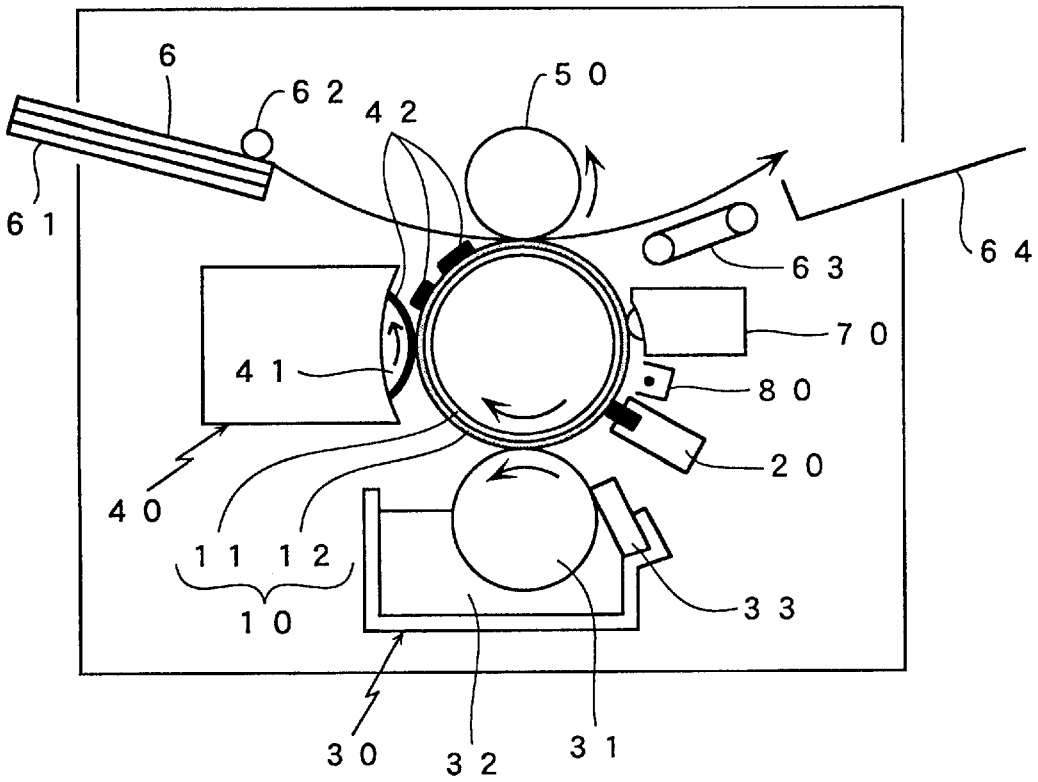
FIG. 1 briefly shows an embodiment of the image forming apparatus of the present invention.

Specific examples of embodiments of the image forming apparatus and method of the present invention are described hereinafter with reference to the accompanying drawings. FIG. 1 briefly shows an image forming apparatus of one embodiment of the present invention.

The image forming apparatus of FIG. 1 comprises an image carrying member 10, electrostatic latent image forming device 20, releasing agent applicator 30, ink developing device 40, transfer device 50, paper feed tray 61 for accommodating transfer sheets 6, discharge tray 64 for accommodating ejected sheets, cleaning device 70, and discharge device 80.

The aforesaid image carrying member 10 comprises a cylindrically shaped conductive substrate 11 and an image supporting layer 12 formed on the substrate 11. The image supporting layer 12 has a dielectric layer formed on the substrate 11 and a lubricative layer formed on the dielectric layer. A multistylus discharge electrode 20 is used as the electrostatic latent image forming device 20 which forms an electrostatic latent image on the surface of the image carrying member 10. Releasing agent applicator 30 applies a releasing agent of silicone oil 32 to the surface of the image carrying member 10 on which a latent image is formed. Ink developing device 40 supplies ink 42 to a latent image formed on the image carrying member 10 to form an ink image. The transfer roller 50 used as transfer device transfers the ink image formed on the image carrying member 10 onto a recording medium (transfer sheet). Cleaning device 70 removes the residual ink 42 from the surface of image carrying member 10 after the ink image has been transferred. Discharger 80 discharges the surface of the image carrying member 10 after it has been cleaned.

Although the aforesaid image carrying member 10 comprises a cylindrical conductive substrate on which are sequentially overlaid a dielectric layer and a lubricative layer, it is to be understood that the present invention is not limited to this configuration inasmuch as a film, drum, endless belt or like configurations also may be used. Examples of usable materials for constructing the conductive substrate used in image carrying member 10 include aluminum, iron, copper, nickel, SUS stainless steel, gold, silver, chrome, platinum, tin, titanium, and like metals and alloys thereof, as well as conductive substrates formed by dispersing microparticles of conductive materials in resin.

The material used to construct the dielectric layer of image carrying member 10 is desirably a dielectric material having a volume resistivity of $1\times10^{15}$ Ω·cm or greater for preventing a drop in surface potential, such as, for example, polyester, polypropylene, polyvinylalcohol, vinyl polyacetate, ethylene-vinyl acetate copolymer, methyl polymethacrylate, polycarbonate, polystyrene, acrylonitril-methacrylate copolymer, acrylonitril-butadiene-styrene copolymer, ethylene polyterephthalate, polyurethane elastomer, viscose rayon, cellulose nitrate, cellulose acetate, cellulose triacetate, cellulose propionate, cellulose acetate butyrate, ethyl cellulose, regenerated cellulose, polyamide (nylon 6, nylon 66, nylon 11, nylon 12, nylon 46 and the like), polyimide, polysulfone, polyether sulfone, polyvinyl chloride, vinyl chloride-vinyl acetate copolymer, vinylidene polychloride, vinylidene chloride-vinyl chloride copolymer, vinylnitril rubber, polytetrafluoroethylene, polychlorofluoroethylene, vinyl polyfluoride, vinylidene polyfluoride and like resin materials, as well as inorganic materials such as $Al_2O_3$, $SiO_2$, $TiO_2$ and the like, used individually or in combinations of two or more.

The material used to construct the lubricative layer used in the image carrying member 10 will desirably be a material having a low tackiness relative to ink, such as, for example, silicone resin, fluorosilicone resin, fluoride resin and the like used individually or in combinations of two or more. Furthermore, since polyethyleneterephthalate (PET), which is a desirable dielectric material, has a contact angle relative to water of 67 degrees, it is desirable that the material of the lubricative layer has a contact angle sufficiently larger than that of the material of the dielectric layer, the material having a contact angle of 80 degrees or higher relative to water is desirable, the material having a contact angle of 80 to 130 degrees is more desirable, and the material having a contact angle of 90 to 130 degrees is still more desirable. Examples of usable commercial materials include Silicone Resin TPR6722 (Toshiba Silicone Co., Ltd; water contact angle 110 degrees), UV9300 (Toshiba Silicone Co., Ltd; water contact angle 104 degrees), Fluorosilicone Resin AY43-158E (Toray Dow Corning Silicone Co., Ltd; water contact angle 100 degrees), and Fluororesin CTFE (Daikin Co., Ltd.; water contact angle 95 degrees) and the like.

An electrostatic latent image forming device which selectively charges the surface of image carrying member 10 to form a desired electrostatic latent image thereon may be used as the electrostatic latent image forming device 20, for example an electrostatic latent image forming device of the ion flow type may be used to discharge from a photosensitive member by light exposure of a transparent photosensitive member. Since there is concern that adequate image density will not be obtained if ink 42 is inadequately supplied when the electrostatic latent image has a low surface potential, and conversely there is concern that non-printing white spots will occur in the image region of the formed image when the surface potential of the latent image is excessively high, it is desirable that the absolute value of the surface potential in the latent image region is set within a range of 200 to 2,000 V.

Releasing agent applicator 30 internally stores a releasing agent of silicone oil 32, and comprises an oil applicating roller 31 disposed so as to be rotatable, and an oil regulating blade 33 to regulate the amount of silicone oil on the surface of oil applicating roller 31. It is desirable that the silicone oil applied to the surface of the image carrying member 10 is applied to a thickness of 0.1 to 10 μm. Although well known releasing agents may be used as the releasing agent, silicone oil is desirable from the perspective of its ease of handling.

Ink developing device 40 internally accommodates ink 42 having a volume resistivity of more than $1\times10^{8}$ Ω·cm, and maintains a thin layer of said ink 42 on the surface of ink carrying member 41, which is rotated so as to have the thin layer of ink 42 come into contact with the image carrying member 10 and develop the electrostatic latent image formed thereon as an ink image. The means for forming the aforesaid thin layer of ink on the surface of ink carrying member 41 is not specifically restricted, and any well-known means may be optionally used, such as, for example, a regulating blade and the like. The thickness of the thin layer of ink 42 formed on the surface of ink carrying member 41 is desirably 1 to 50 μm. When the thin ink layer is excessively thin, sufficient image density is not obtained, whereas when the thin ink layer is excessively thick, fogging readily occurs in the obtained image.

It is possible to use ink 42 composed of a colorant, a vehicle, an additive added as required, and so on which is represented by ink for printing, for example. Lithographic ink used for lithographic printing out of various types of printing ink is preferably used, and oily ink particularly preferable.

Well known colorants such as pigments and the like may be used as color materials, for example, black pigments such as carbon black, yellow pigments such as yellow oxide, red pigments such as lake red C, brilliant carmine 6B, rhodamine 6 and the like, and blue pigments such as Prussian blue, ultramarine and the like.

Examples of useful vehicles include oil, resin, solvent, and plasticizer as necessary. Examples of desirable oils include vegetable oils such as linseed oil, china wood oil and the like, as well as other oils such as treated oil, mineral oil and the like. Examples of resins which are usable as a vehicle include synthetic resins such as rosin-modified phenol resin and the like, natural resins such as gilsonite, and natural resin derivatives. Examples of solvents which are useful as a vehicle include high boiling point petroleum solvents such as tetradecane, pentadecane and the like. Esters such as adipic acid, sebacic acid and the like, as well as plasticizers such as paraffin chloride and the like may be added to the vehicle as necessary.

Examples of useful additives which may be added to the ink as necessary include waxes such as vegetable wax, animal wax, mineral wax, synthetic wax and the like, siccative such as metallic soap, organic acids and the like, surface active agents such as lecithin, sorbitan resin acid ester and the like, gelatinizers such as castor oil with added hydrogen, aluminum soap and the like.

It is desirable that ink 42 has a high viscosity, the viscosity of about 10,000~1,000,000 cp is desirable, the viscosity of about 100,000~400,000 cp is more desirable from the perspective of preventing fog.

It is further desirable that ink 42 has a high resistance, specifically a volume resistivity of more than $1\times10^8$ Ω·cm is desirable. Although the upper limit of volume resistivity is not specifically limited, $1\times10^{16}$ Ω·cm is a practical limit. Volume resistivity of the ink is a value measured by the sequence described below. First, a 3 ml sample of the ink is placed on a fluid electrode (model LE-22; Ando Denki K. K.) provided with a first rode-like electrode and a second electrode formed as a concavity having a diameter larger than said first electrode. The distance L between the first electrode and second electrode is 0.15 cm, and from this then surface area S of the ink in contact with the electrode can be calculated. A voltage V of 300 V is applied between the first and second electrodes, and the current value I is read by an ammeter connected in series to the aforesaid fluid electrode and an equivalent circuit. The volume resistivity ρ (Ω·cm) is calculated from $\rho=(V/I)\cdot(S/L)$.

A transfer roller is used as transfer device 50. A transfer sheet 6 accommodated in paper tray 61 is fed therefrom by a feed roller 62, so as to be guided between said transfer roller 50 and the image carrying member 10 upon which is formed an ink image, such that said ink image is transferred onto transfer sheet 6 via pressure applied by the transfer roller 50.

The transfer sheet 6 which carries the transferred ink image is transported via transport belt 63 and ejected to discharge tray 64. After the aforesaid image transfer, the residual ink remaining on the surface of the image carrying member 10 is removed therefrom by cleaning device 70, and thereafter the surface of the image carrying member 10 is discharged by discharger 80.

Although the details of the image forming process accomplished by the image forming apparatus of the present invention are not yet fully elucidated, the inferred details are described below.

First, the thin layer of ink 42 maintained on the surface of ink carrying member 41 comes into contact with the releasing agent 32 coating the surface of the image carrying member 10 via the rotation of said ink carrying member 41. A charge having a polarity opposite the polarity of the charge of the surface of image carrying member 10 is induced in the surface of the ink 42 by the charge of the surface of image carrying member 10 passing through the releasing agent 32 on the surface of image carrying member 10. Therefore, the thin layer of ink 42 receives an electrostatic force so as to be drawn toward the image carrying member 10 and repel the layer of releasing agent 32.

Ink carrying member 41 separates from the image carrying member 10, and when the distance between said two members exceeds a predetermined value, the electrostatic force between the charge of the image carrying member 10 and the layer of ink 42 in the image areas is greater than the flocculation force of the ink 42, such that ink 42 is cut to a predetermined thickness with the remaining in staying on the releasing agent 32 side and producing an ink image.

On the other hand, the thin layer of ink 42 in the non-image area does not migrate to the releasing agent 32 side due to the flocculation force of the ink 42 itself, thereby preventing the disadvantage of image fog because the ink 42 is retained on the surface of the ink carrying member 41.

Then, a transfer sheet 6 is guided between the transfer roller 50 and the image carrying member 10 bearing the aforesaid ink image, and said ink image is transferred onto the transfer sheet 6 via the pressure applied by said transfer roller 50. Since the surface layer of image carrying member 10 is a silicone resin layer acting as a lubricative layer, the adhesion force of the ink is reduced, and a high transfer efficiency is achieved. When the surface layer of the image carrying member is a dielectric layer, the adhesion force of the ink is very great, and transfer efficiency is reduced. When a dielectric layer is not formed, the volume resistivity of the image carrying member 10 is reduced, thereby reducing the surface potential.

Specific examples of the embodiments of the present invention are described hereinafter, although it is to be understood that the present invention is not limited to these examples.

COMPARATIVE EXAMPLE 1

In FIG. 1, an aluminum roller having a polyester resin layer 5 μm in thickness as dielectric layer was used as the ink carrying member 41. A lithographic ink having a volume resistivity of $1.9\times10^9$ Ω·cm (Dycure Scepter Process India Ink N; Dainippon Ink & Chemicals, Inc.) was used as ink 42 to form a thin ink layer about 10 μm in thickness on the surface of ink carrying member 41. An aluminum tube 80 mm in diameter, and on the surface of which was provided with a polyethylene terephthalate (PET; water contact angle of 67 degrees; volume resistivity $1\times10^{17}$ Ω·cm) layer 14 μm in thickness was used as the dielectric layer. A tungsten wire 50 μm in diameter was used as an electrostatic recording head, and arranged at a distance of about 20 μm from the image carrying member 10, to form an electrostatic latent image having a surface potential of about −500 V on the surface of the image carrying member 10. Silicone oil (SH200; Toray Dow Corning Silicone Oil Co., Ltd.) having a viscosity of 300 cp was used as the releasing agent 32 applied to the image carrying member 10, and was applied to the surface of image carrying member 10 at a thickness of about 1 μm via releasing agent applicator 3. Ink carrying member 41 was grounded.

When image formation was performed under these conditions, an image without fog was produced, but a residual ink image remained on the surface of image carrying member 10 due to poor image transfer.

COMPARATIVE EXAMPLE 2

An image was formed in the same manner as described in Comparative Example 1 with the exception that the surface of an aluminum tube 80 mm in diameter was provided with a layer of silicone resin (TPR6722; water contact angle of 110 degrees; Toshiba Silicone Co., Ltd.) 20 μm in thickness as a lubricative layer. Retention of the ink image on the surface of image carrying member 10 was prevented, and although transfer characteristics improved, the resulting image density was reduced.

EXAMPLE

An image was formed in the same manner as described in Comparative Example 1 with the exception that the surface of an aluminum tube 80 mm in diameter was provided with a layer of polyethylene terephthalate (PET; water contact angle of 67 degrees; volume resistivity $1\times10^{17}$ Ω·cm) 14 μm in thickness as a dielectric layer, and a layer of silicone resin (TPR6722; water contact angle of 110 degrees; Toshiba Silicone Co., Ltd.) 10 μm in thickness was overlaid thereon as a lubricative layer. Retention of the ink image on the image carrying member was prevented and transfer characteristics improved, so as to produce a sharp image of suitable image density without fog.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An image forming apparatus comprising:

an image carrying member supporting electrostatic latent images and comprising a conductive substrate, a dielectric layer and a lubricative resin layer as a surface layer;

a developing device comprising an ink carrying member which supports a liquid ink layer, the developing device forming ink images corresponding to the electrostatic latent images on the image carrying member; and a transporting device transporting the ink images to a recording medium.

2. The image forming apparatus of claim 1, wherein the lubricative resin layer comprises at least one resin selected from the group essentially consisting of silicone resin and fluorine containing resin.

3. The image forming apparatus of claim 1, wherein a contact angle of the lubricative resin layer is more than that of the dielectric layer.

4. The image forming apparatus of claim 1, wherein a contact angle of the lubricative resin layer is more than 80°.

5. The image forming apparatus of claim 4, wherein the contact angle of the lubricative resin layer is 80° to 130°.

6. The image forming apparatus of claim 1, wherein the dielectric layer has a volume resistance of more than $1\times10^{15}$ Ω·cm.

7. The image forming apparatus of claim 1, wherein the ink layer supported on the ink carrying member has a thickness of 1 to 50 μm.

8. The image forming apparatus of claim 1, wherein the ink has a volume resistance of more than $1\times10^{8}$ Ω·cm.

9. The image forming apparatus of claim 1, comprising a releasing agent coating device which coats a releasing agent to the surface of the image carrying member.

10. An image forming apparatus comprising:

an image carrying member supporting electrostatic latent images and comprising a conductive substrate and an image supporting layer which has a volume resistance of more than $1\times10^{15}$ Ω·cm and has a lubricative surface composed of a lubricative resin;

a developing device comprising an ink carrying member which supports a liquid ink layer, the developing device forming ink images corresponding to the electrostatic latent images on the image carrying member; and a transporting device transporting the ink images to a recording medium.

11. The image forming apparatus of claim 10, wherein a contact angle of the surface of the image supporting layer is more than 80°.

12. The image forming apparatus of claim 11, wherein the contact angle is 80°to 130°.

13.The image forming apparatus of claim 11, wherein the ink has a volume resistance of more than $1\times10^{8}$ Ω·cm.

14. The image forming apparatus of claim 11, wherein the surface of the image supporting layer comprises at least one resin selected from the group essentially consisting of silicone resin and fluorine containing resin.

15. An image forming method comprising the steps of:

forming electrostatic latent images on a surface of an image carrying member which comprises a conductive substrate, a dielectric layer and a lubricative resin layer;

forming ink images on the image carrying member by means of contacting a liquid ink to the electrostatic latent images on the image carrying member; and transporting the ink images to a recording medium.

16. The image forming method of claim 15, wherein the lubricative resin layer comprises at least one resin selected from the group essentially consisting of silicone resin and fluorine containing resin.

17. The image forming method of claim 15, wherein a contact angle of the lubricative resin layer is more than that of the dielectric layer.

18. The image forming method of claim 15, wherein a contact angle of the lubricative resin layer is more than 80°.

19.The image forming method of claim 15, wherein the dielectric layer has a volume resistance of more than $1\times10^{15}$ Ω·cm.

20. The image forming method of claim 15, wherein the ink has a volume resistance of more than $1\times10^{8}$ Ω·cm.

* * * * *